US005178528A

United States Patent [19]

Malfit

[11] Patent Number: 5,178,528

[45] Date of Patent: Jan. 12, 1993

[54] HYDRAULIC GENERATOR-RECEIVER FOR POWER TRANSMISSION

[76] Inventor: Jean Malfit, Le Napoléon 2, rue de Chapotte, FR-07300 Tournon, France

[21] Appl. No.: 781,572

[22] Filed: Oct. 23, 1991

[30] Foreign Application Priority Data

Oct. 24, 1990 [FR] France ..... 90 13411

[51] Int. Cl.[5] ..... F03C 2/08; F04C 2/16; F04C 5/00; F04C 15/00

[52] U.S. Cl. ..... 418/72; 418/132; 418/152; 418/201.1

[58] Field of Search ..... 418/72, 75, 125, 129, 418/131, 132, 152, 179, 197, 201.1

[56] References Cited

U.S. PATENT DOCUMENTS

| | | | |
|---|---|---|---|
| 2,966,860 | 1/1961 | Maynard | 418/152 |
| 3,057,303 | 10/1962 | Lauck | 418/132 |
| 3,331,551 | 7/1967 | Sneen | 418/131 |
| 3,348,492 | 10/1967 | Olson et al. | 418/131 |
| 3,363,578 | 1/1968 | Sisson | 418/132 |
| 4,395,207 | 7/1983 | Manttri et al. | 418/131 |
| 4,773,837 | 8/1988 | Shimomura et al. | 418/197 |
| 4,781,552 | 11/1988 | Malfit | 418/72 |

FOREIGN PATENT DOCUMENTS

| | | | |
|---|---|---|---|
| 0262189 | 4/1988 | European Pat. Off. . | |
| 941675 | 7/1982 | U.S.S.R. | 418/132 |
| 1386744 | 4/1988 | U.S.S.R. | 418/129 |

*Primary Examiner*—John J. Vrablik

*Attorney, Agent, or Firm*—Pollock Vande Sande & Priddy

[57] ABSTRACT

In a generator-receiver for power transmission, side plates are molded on an insert with a good coefficient of friction whose outer face is flush with the inner face of each side plate and which comprises two circular parts joined by a bi-concave joint, the insert comprising grooves in each of which the plastic material constituting the side plates penetrates to form a bead in which each cavity is formed.

4 Claims, 11 Drawing Sheets

HYDRAULIC GENERATOR-RECEIVER FOR POWER TRANSMISSION

FIELD OF THE INVENTION

The present invention relates to a hydraulic generator-receiver for power transmission.

BACKGROUND OF THE INVENTION

U.S. Pat. No. 4,781,552 which is incorporated herein by reference, discloses such an apparatus, comprising two coupled helical gears 9, 10 within a stator, at least one of which gears is devoid of a mechanical bearing, and further comprises at least one inlet opening 40 and one delivery opening 40 for a liquid under pressure, while two side plates 21, 22 enclose the stator on either side of the two gears 9, 10 on which they form a lateral seal.

U.S. Pat. No. 5,028,221 describes such an apparatus of which the driving gear 9 alone is provided with mechanical bearings 123.

The stator comprises a flexible envelope 36 subjected externally to centripetal pressure which enables it to ensure a seal on the tip of the teeth of the helical gears 9, 10 located within the envelope 36. The forces of hydrostatic compensation on the side plates 21, 22 and on the envelope 36 originate, on the one hand, from the pressure of the permanent total pressure zone 34 and, on the other hand, from the pressure prevailing in the hydrostatic balancing compensation sectors 38, 38′ and 60, 60′, 60″, respectively, of the envelope and the side plates. These sectors are supplied via channels 43 and 23. Two covers 54, 55 cover the side plates, while a body 49 surrounds the envelope 36.

Internal hydraulic balancing is ensured by a hydraulic winding comprising rotor conduits in the gears 9 and 10 and stator conduits in the side plates 21 and 22 and the envelope 36, the successive commutations between the rotor and stator conduits being ensured by the passage of their ends one before the other in a commutation circle 20. Balancing between the tooth spaces is ensured by the permanent link between the opposing tooth spaces when the number of teeth is even, and the opposing tooth spaces with an offset of a half step when the number of teeth is odd, via the conduits 23 of the side plates and the channels made in the gears. Of course, such link does not exist between the meshing zone 3 and zones 6, respectively, in which are created hydraulic bearings diametrically opposite the meshing point 3 of the gears 9 and 10. In this way, during rotation of gears 9 and 10, there is a hydraulic winding system which links the opposing pairs of teeth into a relationship such as to obtain the same hydraulic pressure in the tooth spaces for diametrically opposite angular positions and to create hydraulic bearings which develop two reverse forces on the gears with a view to ensuring that they mesh in zone 3 without play.

In U.S. Pat. No. 5,028,221, the rotor circuits in the gears 9, 10 are constituted by groups of conduits 102 diametrically opposite on the commutation circle 20 and parallel (or inclined at the value of the angle of the helix) to the axis of the gears 9, 10 and radial 101, joining the conduits 102 opposite by $\pi$ to form an H. The stator circuits are constituted by grooves 23, links 30 and conduits 43. Supply of high pressure to the permanent total pressure zone 34 is effected by a preferential valve system also allowing decompression of this zone 34 when desired. Seal anti-extrusion devices are incorporated in the hydrostatic compensation sectors 38 and 60 respectively defined by seals 37 and 45, zone 34 being defined outside these seals and closed on the axis of the gears 9 and 10 by the seals 58.

The embodiment according to U.S. Pat. No. 5,028,221 risks deformation of the side plates 21 and 22 made of plastic material in the zones where they present grooves 100 when low pressure prevails therein, while the outside of the side plates is at permanent total high pressure coming from zone 34. Similarly, this embodiment has provided seal anti-extrusion devices also serving as reinforcement for the plastic pieces at the level of the outlet openings 40. These devices are not entirely satisfactory, in that they lead to making the outlet openings 40 solely in the side plates and covers and do not enable them to be made in the envelope 36 and the body 49, which envelope might be deformed by the high pressure.

Finally, for large cubic capacities, the increase in the diameter of the gears leads to a proportionate increase in the number of sectors, which renders production more expensive due to the larger number of sectors and more difficult to balance due to the sectors at intermediate pressures.

SUMMARY OF THE INVENTION

It is an object of the present invention to overcome these drawbacks and to provide a generator-receiver which responds particularly well to the needs of the art.

To that end, in order to avoid the risk of collapse of the side plates, a reinforcing insert having one face flush with its inner wall opposite each gear 9, 10 is embedded in each side plate. In addition, the covers and the body comprise projections directed towards the inside of the apparatus and adapted to penetrate into depressions in the hydrostatic compensation sectors of the side plates and the envelope respectively. With a view to facilitating adjustments of the pieces made of plastic materials, i.e., the side plates and the envelope, the projections of the covers and of the body comprise sections with oblique faces with respect to which the plastic pieces are force-fitted. The devices for supply of zone 34 and for return of the leakages have been simplified. To reduce the action of zone 34 on the side plates at the level of grooves 100, particularly when the latter are at low pressure, zone 34 has been reduced on the surface and therefore in resultant force by a new relative arrangement of the seals 58 and 45, 45′ and 45″. Finally, for large cubic capacities, the solution adopted consists in multiplying the number of planet gears (i.e., gears driven by the main gear), each planet gear always having four sectors (2 HP and 2 LP), and the main gear having a number of sectors as a function of the number of planet gears, the sectors always being either HP or LP and separated from each other by zone 34 of value corresponding to the value of the "hydraulic bearings" at 6.

BRIEF DESCRIPTION OF THE DRAWINGS

The invention will be more readily understood on reading the following description with reference to the accompanying drawings.

DESCRIPTION OF PREFERRED EMBODIMENT

Figure 1:
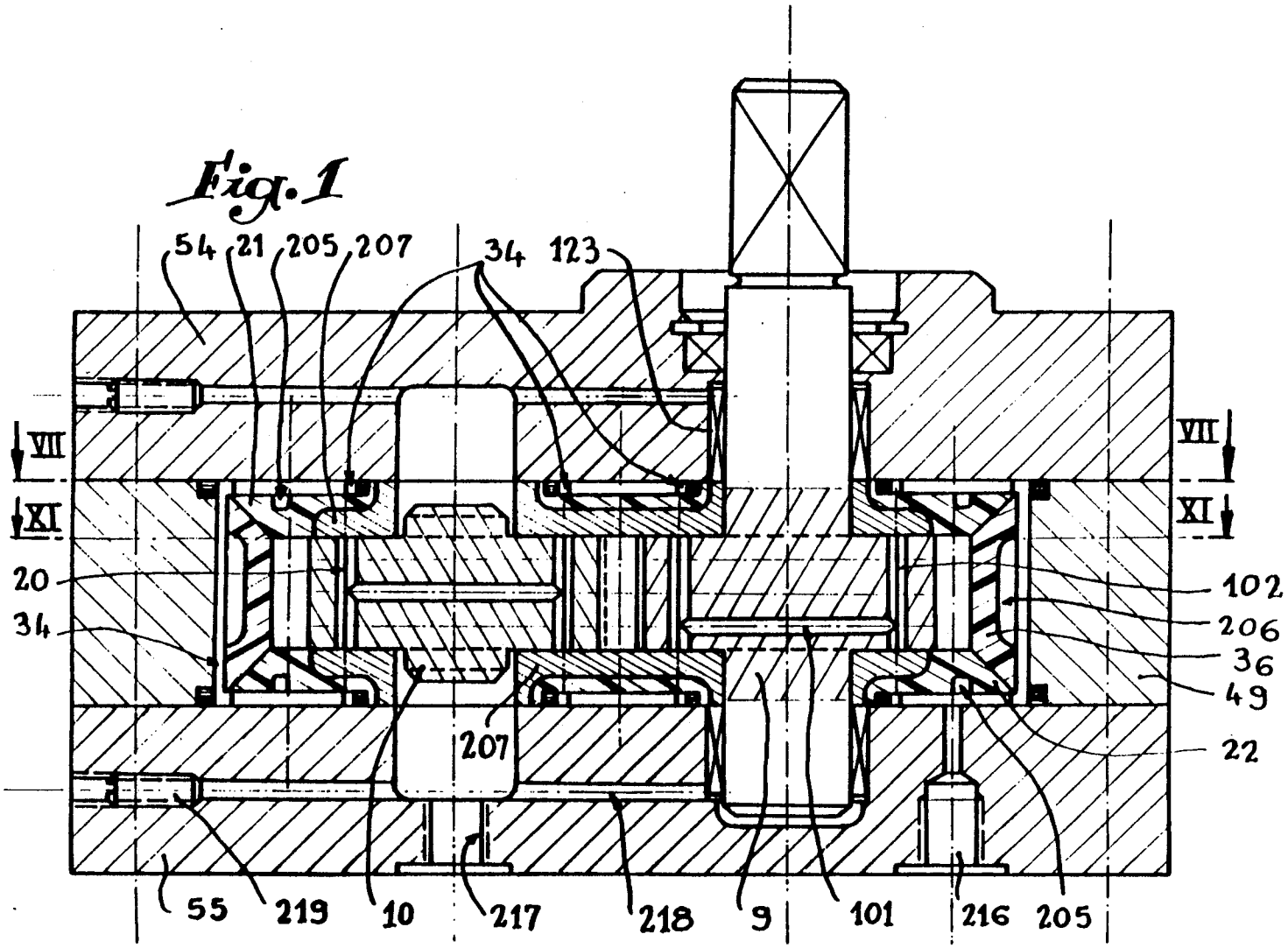
FIG. 1 is a longitudinal section through an apparatus incorporating the improvements according to the invention.
Figure 2:
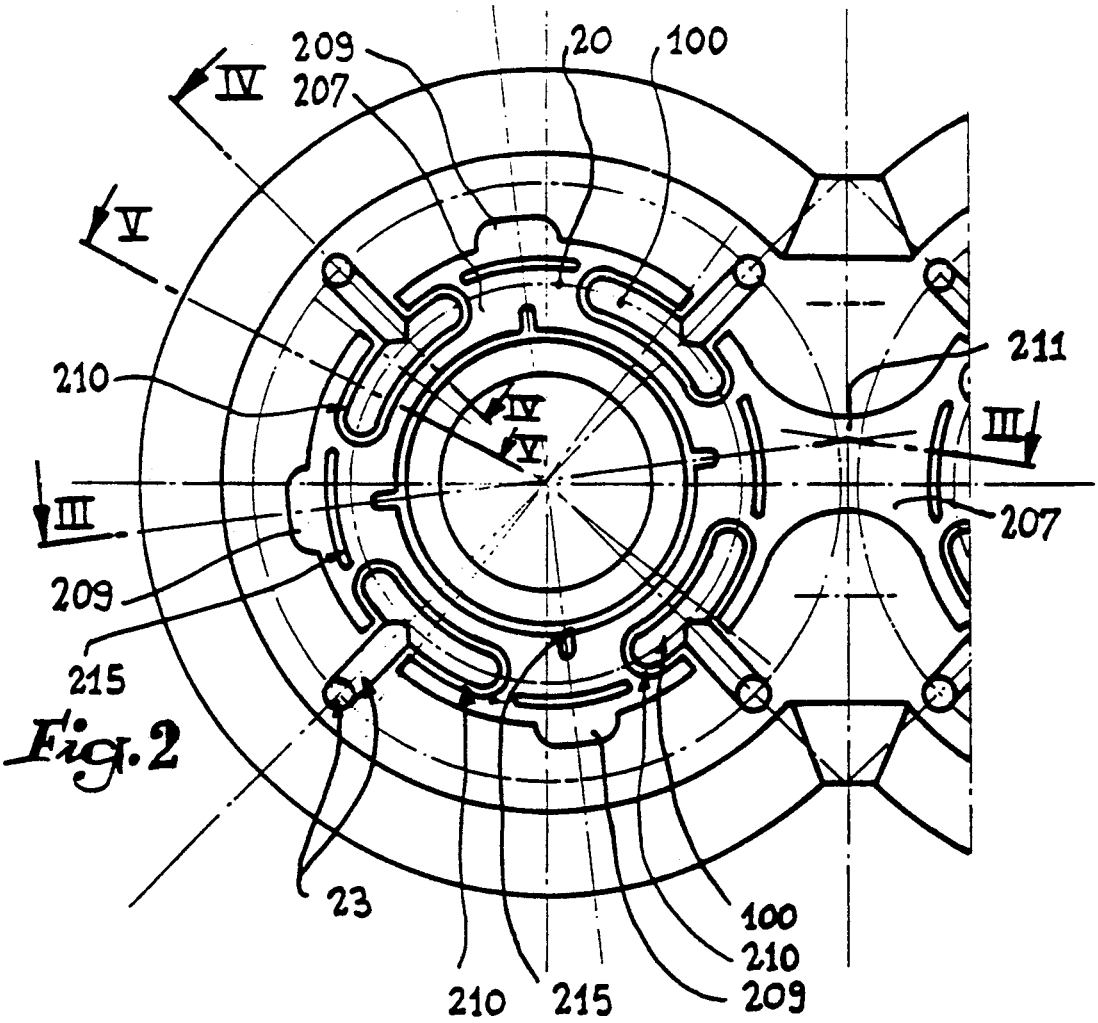
FIG. 2 is a partial view of a side plate seen from the inside of the apparatus.

Referring now to the drawings and firstly to FIGS. 1 to 6, each of the side plates 21, 22, made of plastic material, comprises a reinforcing piece in the form of an insert 207. The plastic material of each side plate is moulded on the insert 207 whose outer face is flush with the inner face of each side plate. The insert is made of a metallic material with a high coefficient of friction since it is in sliding contact with the gears 9, 10. The insert 207 presents, in section in plan, the shape of a spectacle face, i.e., it comprises two circular parts joined by a bi-concave joint 211 (FIG. 2). The bi-concave joint 211 may be entirely inserted in the plastic for the part regarding the friction concerning the teeth at the meshing point 3 (FIG. 7): friction on the teeth faces is then produced by the plastic and enables the differences in width H between the teeth of the driving and driven gears, of the order of 0.01 millimeter, to be better compensated.

It will be observed that the insert 207 comprises grooves 210 (FIGS. 2 and 5) in which the plastic material constituting side plates 21, 22 penetrates to form a bead in which is formed each cavity 100 located on the commutation circle 20 and joined by channel 23 to the linking conduits 30.

Each circular part of the insert 207 comprises three radial tabs 209 facing outwardly and disposed between the grooves 210 and corresponding to the hydraulic bearings (FIG. 2).

Figure 3:
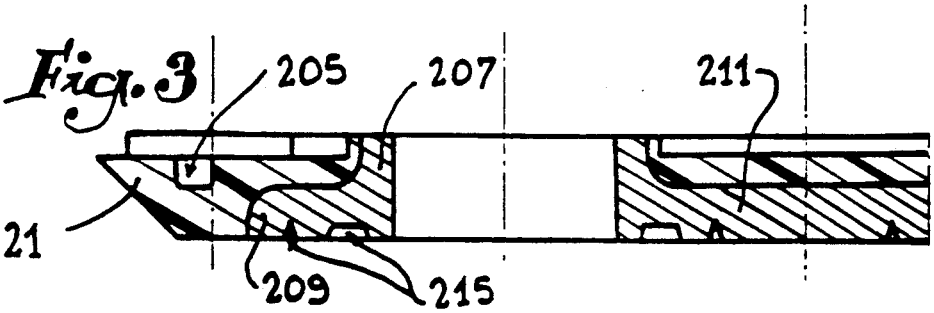
FIGS. 3, 4 and 5 are section views along lines III—III, IV—IV and V—V in FIG. 2.
Figure 4:
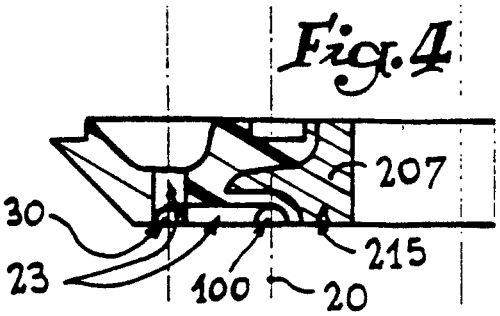
Figure 5:
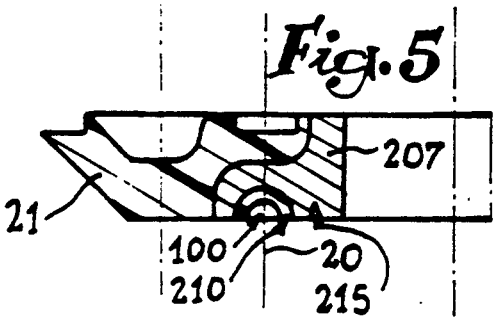
Figure 7:
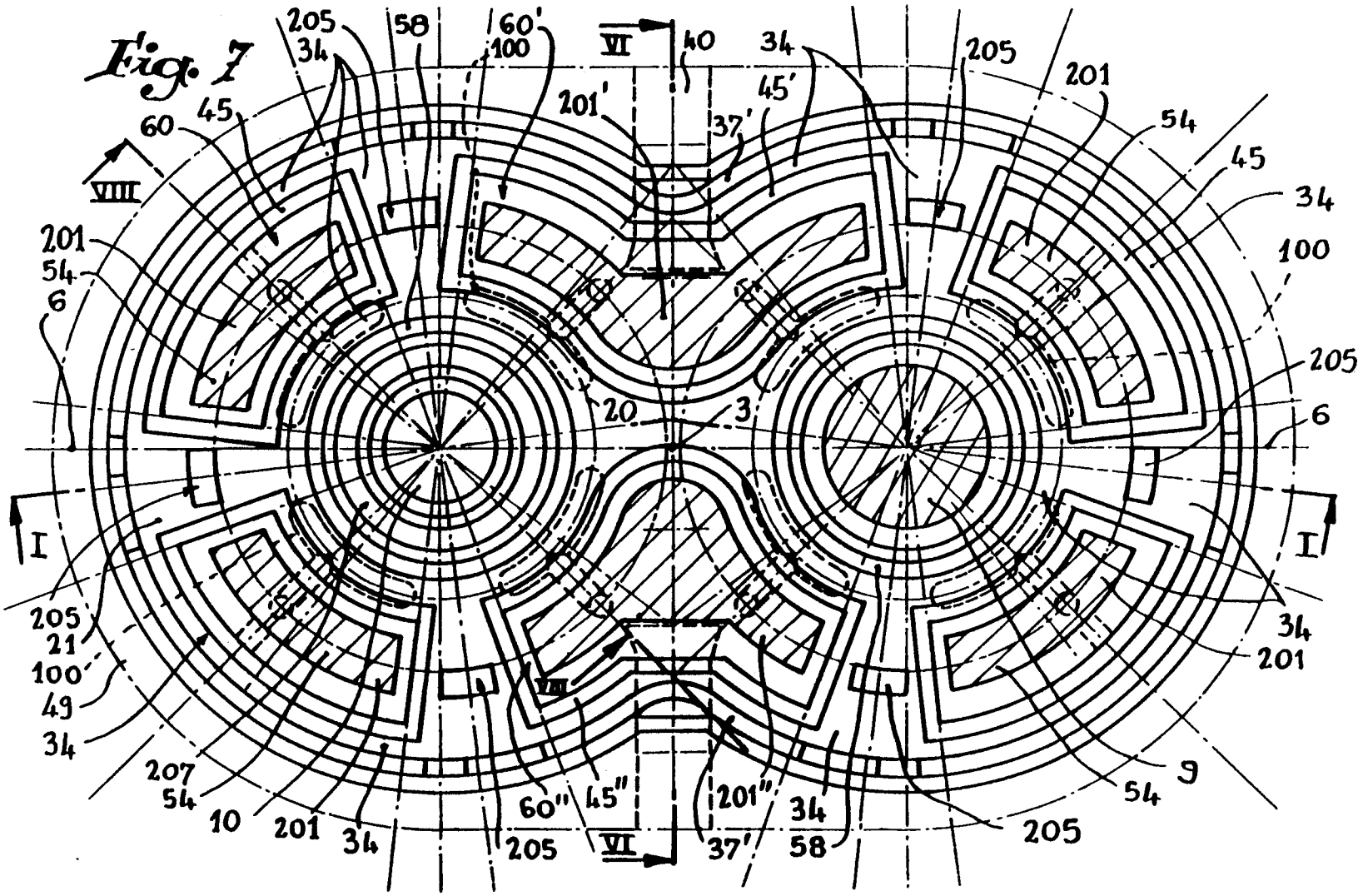
FIG. 7 is a section view along line of VII—VII of FIG. 1; the sectional planes of FIGS. 1 and 6 are shown at I—I and VI—VI, respectively.

In the inter-sector hydrostatic balancing zones and those of the hydraulic bearings, recesses 205 facilitate cooling of the plastic material after the injection operation and give the side plates 21, 11 greater flexibility (FIGS. 3 and 7).

It will be noted that grooves 215 are provided on the face of each insert 207 in contact with the gears 9 and 10 to create fluid bearings.

Figure 6:
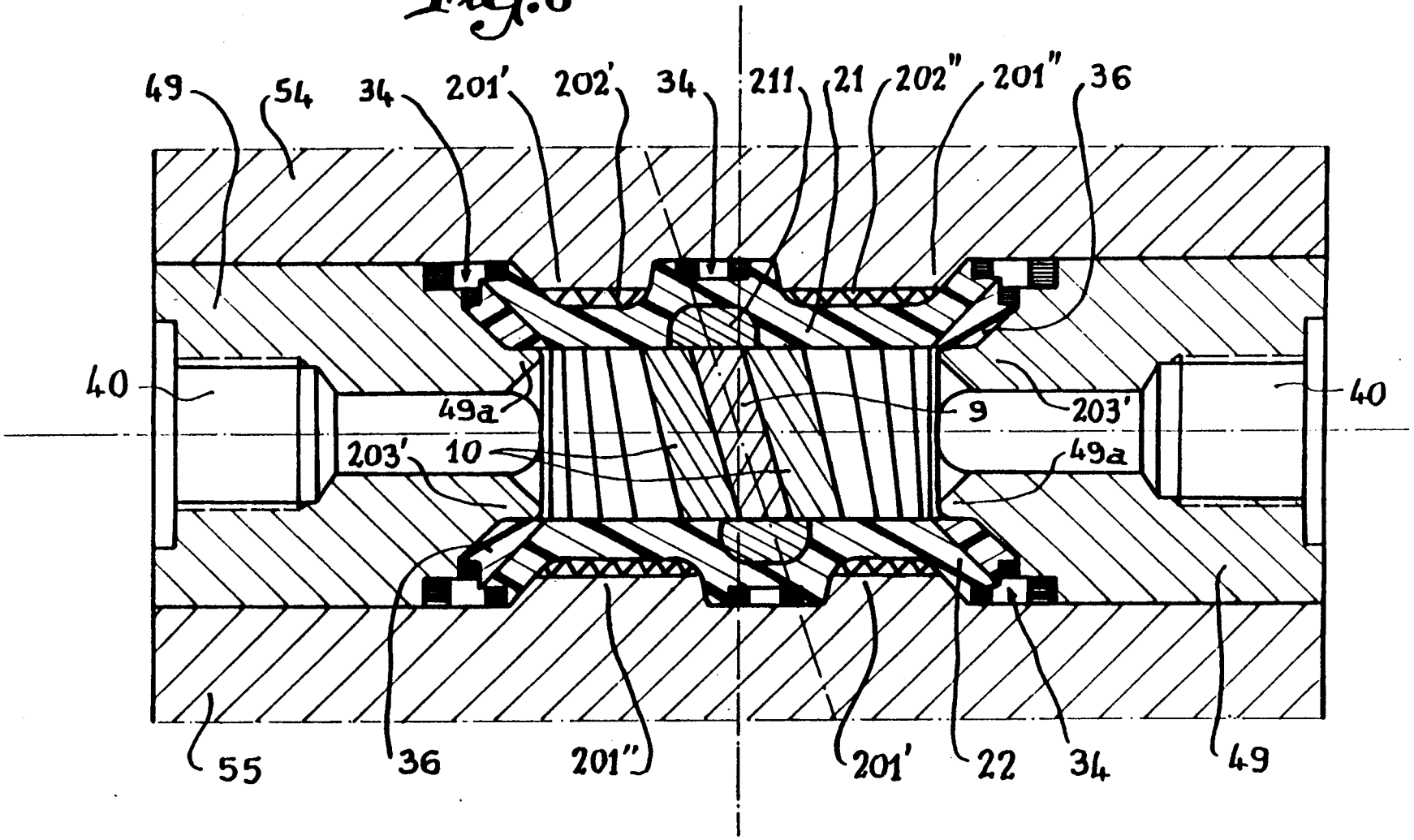
FIG. 6 is a transverse section through the apparatus according to the invention.
Figure 8:
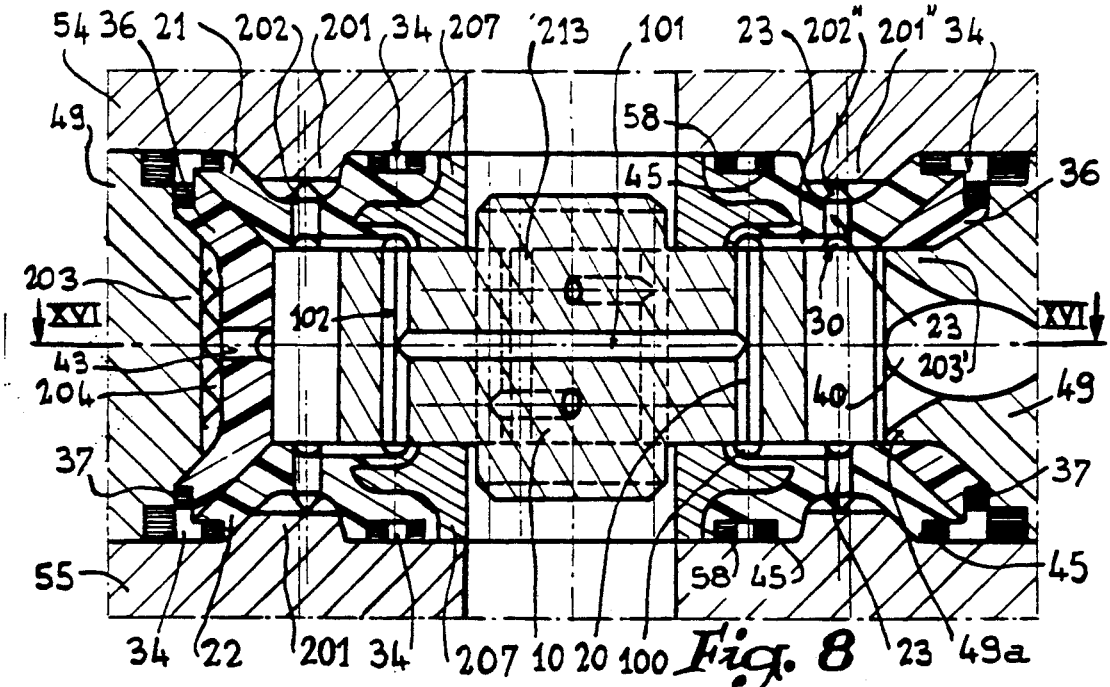
FIG. 8 is a section view along line VIII—VIII of FIGS. 7 and 11.
Figure 9:
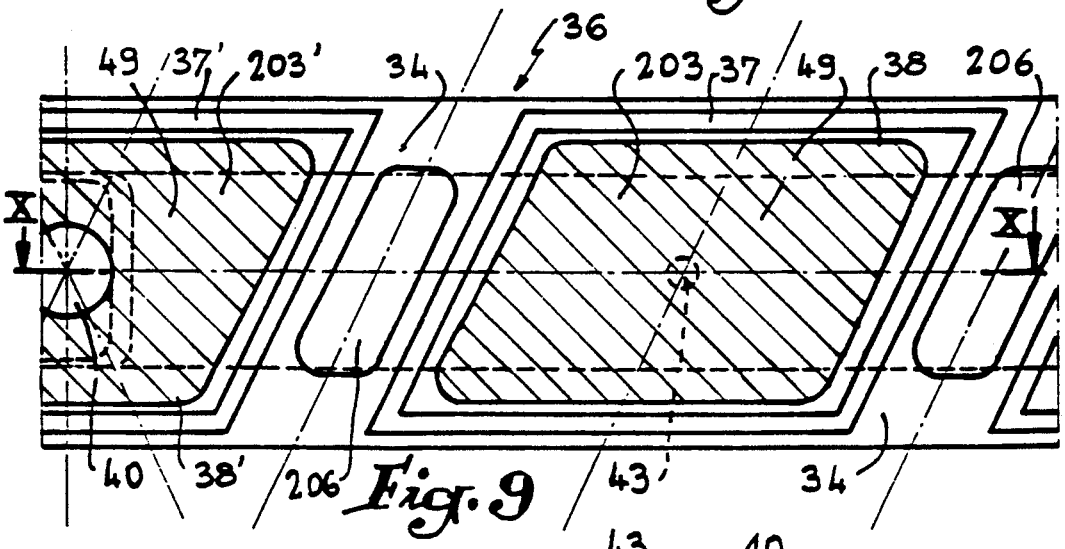
FIG. 9 is a partial developed section view illustrating the interior of the envelope.
Figure 10:
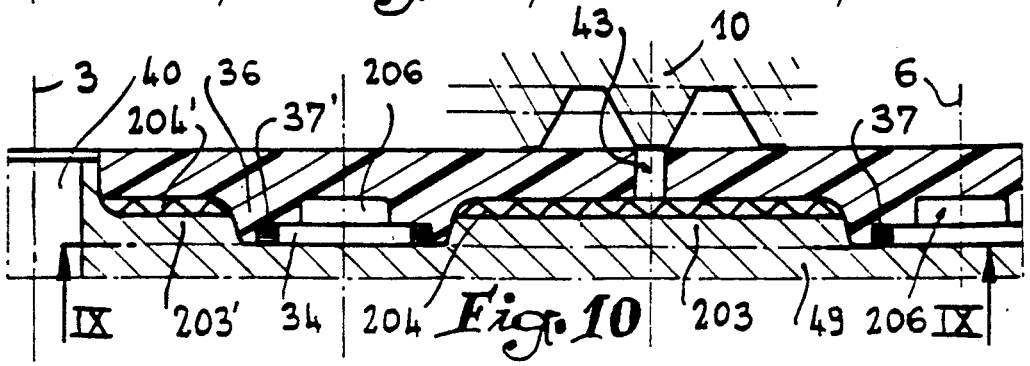
FIG. 10 is a section view along line X—X of FIG. 9. The plane of section of FIG. 9 is shown therein.
Figure 11:
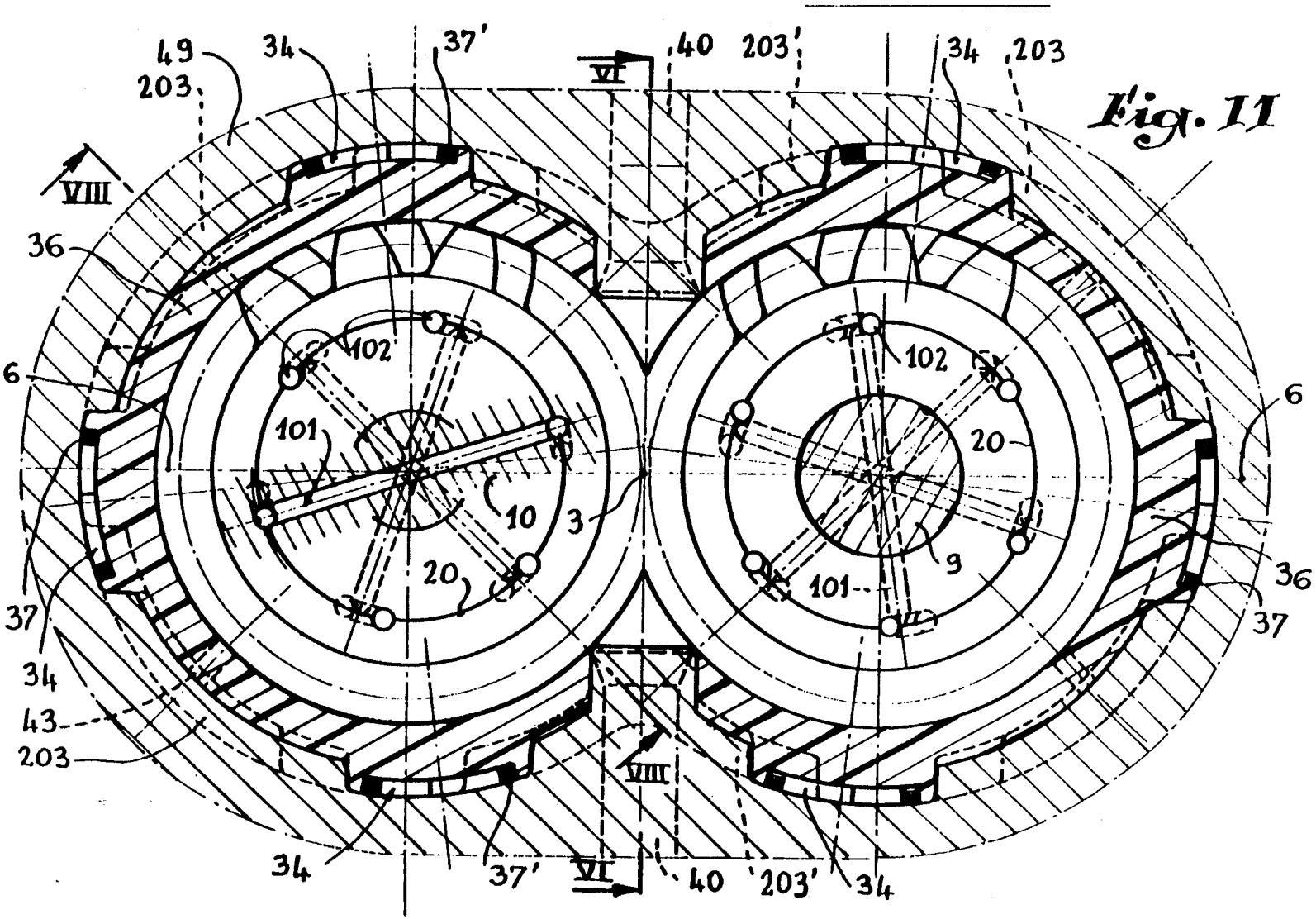
FIG. 11 is a section view along line XI—XI of FIG. 1. The plane of section of FIG. 6 has been shown therein.
Figure 13:
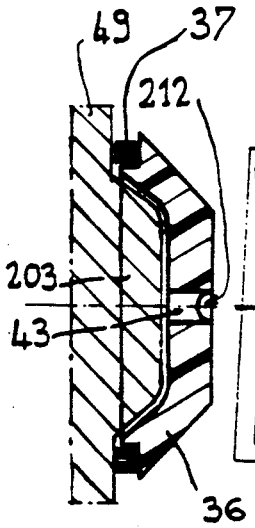
FIG. 13 is a section view along line XIII—XIII of FIG. 12.
Figure 12:
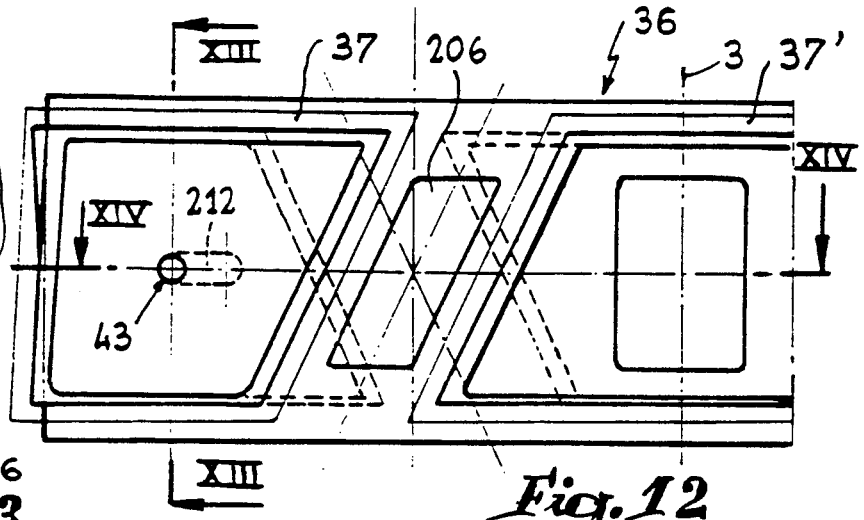
FIG. 12 is a partial outside view of the envelope which surrounds the gears.
Figure 14:
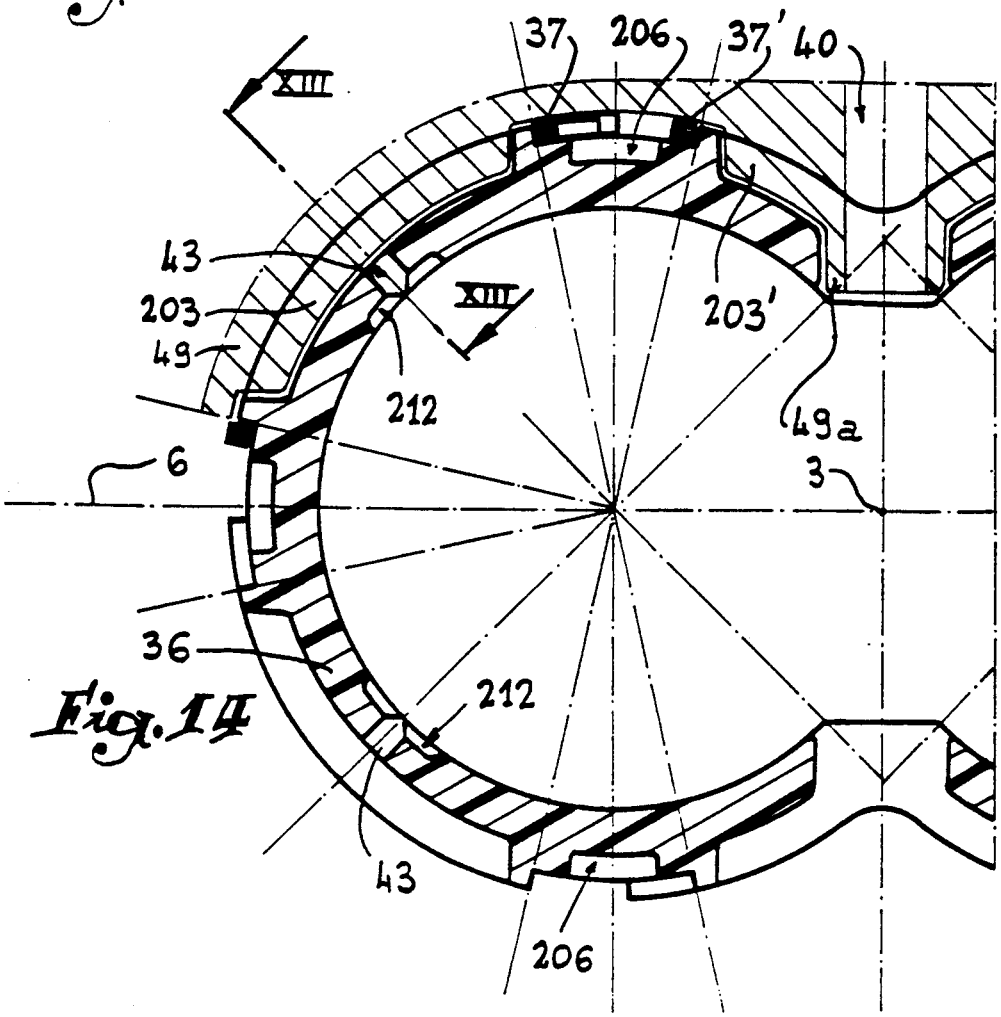
FIG. 14 is a section view along line XIV—XIV of FIG. 12. The plane of section of FIG. 13 has been shown at XIII—XIII.
Figure 15:
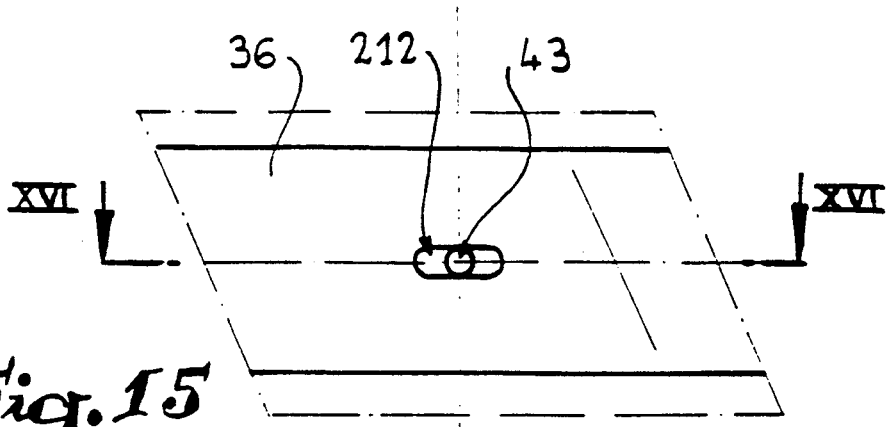
FIG. 15 is a partial developed section view of the outside of the envelope.

FIGS. 6, 7 and 8 illustrate the manner in which the side plates 21 and 22 are anchored with respect to the covers 54, 55. Each of them comprises projections 201 disposed symmetrically with respect to the meshing zone 3 of the gears 9 and 10 (FIG. 7) and extending in the balancing sectors 60 of the side plates 21, 22. A projection 201' shaped as an upturned gendarme's hat, fast with each cover 54, 55, is disposed in one of the balancing sectors 60' located in part opposite the two gears 9 and 10. Another projection 201" in sector 60" is arranged on the covers 54, 55 opposite projection 201'. Its shape is similar to that of the latter, but it is shorter in length due to the configuration of the balancing sectors on flanges 21, 22.

Projections 201, 201', 201" engage by force in the recesses of the side plates 21, 22 so as to ensure clamping at the level of seals 45, 45' and 45" and clearance elsewhere, such engagement and clamping being enabled by a difference in inclination of the order of 5° between the respective faces which cooperate. It will be noted that the ends of the relieved faces of the projections 201, 201', 201" have grooves 202, 202', 202", respectively, hollowed out therein for distribution of pressure.

The projections of the covers constitute seal anti-extrusion devices which are force-fitted in the recesses of the flanges at the level of seals 45, 45', 45".

FIGS. 6, 8, 9, 10 and 11 show that, in the same manner as the side-plates are anchored with respect to the covers, bosses 203, 203' extending in the balancing sectors 38 and 38' and constituting seal anti-extrusion devices cooperating with corresponding depressions in the envelope 36 are arranged in the inner face of the body 49. These bosses 203 and 203' engage by force in the recesses of the envelope 36, so as to ensure clamping at the level of seals 37 and 37' and clearance elsewhere, such engagement and clamping being enabled by a difference in inclination of the order of 5° between the respective faces which cooperate. The ends of the bosses 203, 203' are provided with grooves 204, 204' for distributing pressure (cf. FIGS. 8 to 14). The part of envelope 36 receiving bosses 203' comprises a rectangular opening into which penetrates an element 49*a* of the boss 203 (FIG. 8) of the body 49 provided with orifice 40. This rectangular opening is allowed by the anchoring of the envelope 36 in the bosses 203 and 203' of the body 49 of height slightly less than the width of the toothing in relation with the diametral pitch thereof. In this way, orifices 40 may be made in body 49.

Recesses 206 may be provided in the envelope 36 with a view to facilitating cooling thereof after injection and to giving it greater flexibility (FIGS. 1, 9, 10, 12, 14).

The finishing of the projections 201, 201', 201'' and of bosses 203, 203' as well as the faces of covers 54, 55 and interior ones of the adjacent body 49, is such that it presents a particularly elaborate surface state for receiving the plastic parts of the side plates 21, 22 and of the envelope 36 as well as the seals of the corresponding sectors 60, 60', 60'' and 38, 38'. This surface state is obtained, for example, by a plastic overmolding or a coating of oven-baked epoxy paint. The seal anti-extrusion effect of the projections and bosses is reinforced by a plastic border 0.3 to 0.5 millimeter in height on the periphery of the housings of seals on the side plates 21, 22 and on envelope 36. This border also absorbs the differences in dimensions.

Figure 16:
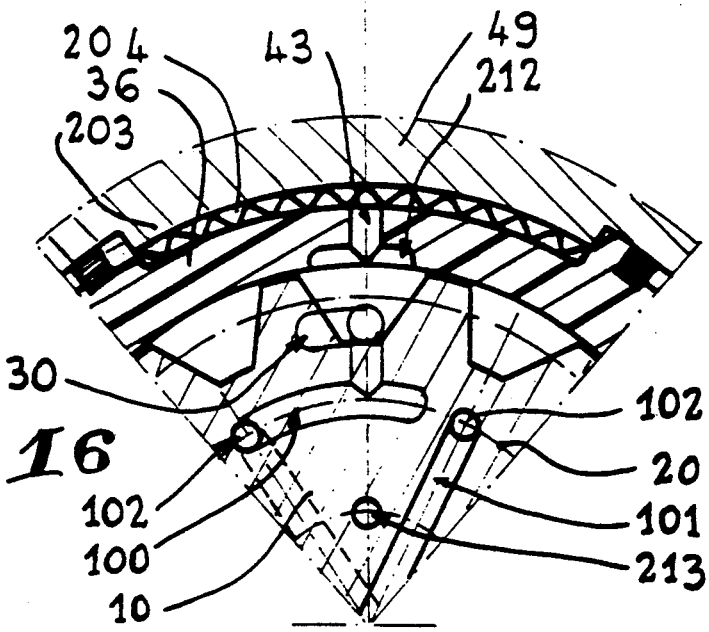
FIG. 16 is a partial section view along line XVI—XVI of FIGS. 8 and 15.

Leakages are recovered by means of conduits 218 closed by a stopper 219 and by a particular conduit 213 (FIG. 16) through the gear 10 and parallel to the axis thereof. The leakages recovered by these conduits are evacuated towards the low pressure circuit via a piping connected in hole 217 (FIGS. 1 and 8). Supply of zone 34, permanent total high pressure zone, is effected via orifice 216 from the high pressure generated or received.

Grooves 30, connected to grooves 100 by conduits 23 (FIG. 4), have a more or less high angular value depending on the operational conditions. In the above example, they are limited to the value of the diameter of the conduit. In fact, due to their respective positions in each of the side plates 21 and 22 with respect to the inclination of the toothings, their value is equivalent to twice the diameter of the conduit (when one is concealed by a solid tooth, the other is always in connection with the tooth space, and vice versa). These grooves 30 may be completed by a groove 212 half-way up the envelope 36, centered on conduit 43, so as always to be able to make groove 30 as short as possible, for example reduced to the diameter of conduit 23. According to the overriding direction of rotation, this groove 212 may be off-centered with respect to conduit 43 in order to promote more rapid pressurization on one side with respect to the other side of the sector. These arrangements are illustrated in FIGS. 12, 13, 14, 15, 16, 17.

Figure 17:
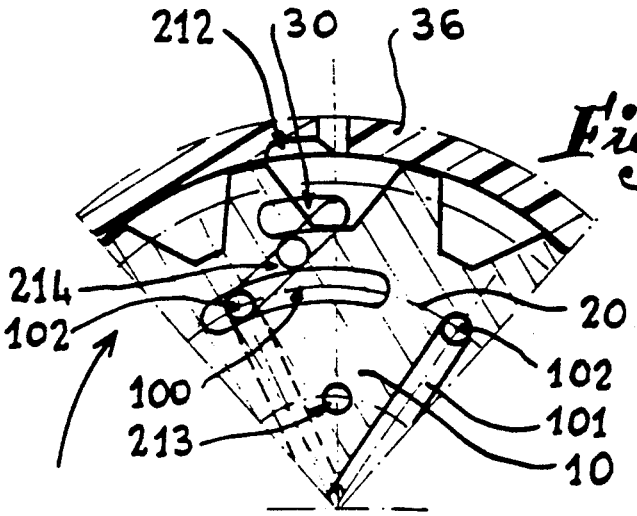
FIG. 17 is a section view similar to that of FIG. 16, but illustrating a variant embodiment.
Figure 18:
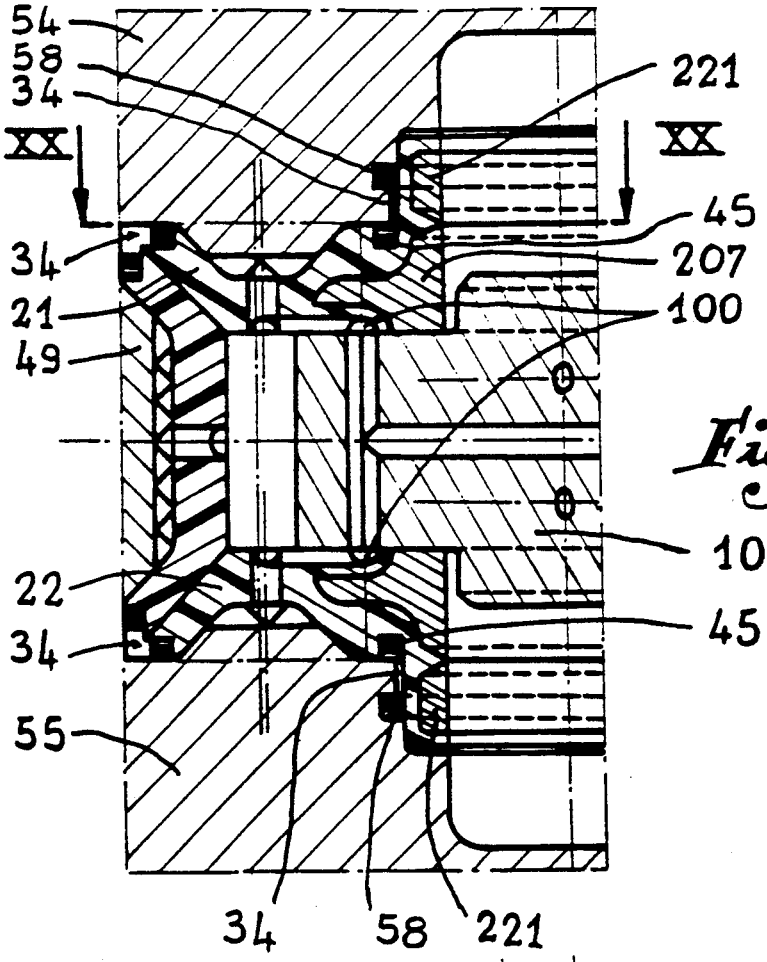
FIG. 18 is a partial section view along line XVIII—XVIII of FIG. 20 illustrating the new relative arrangement of the seals 58 and 45 on the side of driven gear 10.
Figure 20:
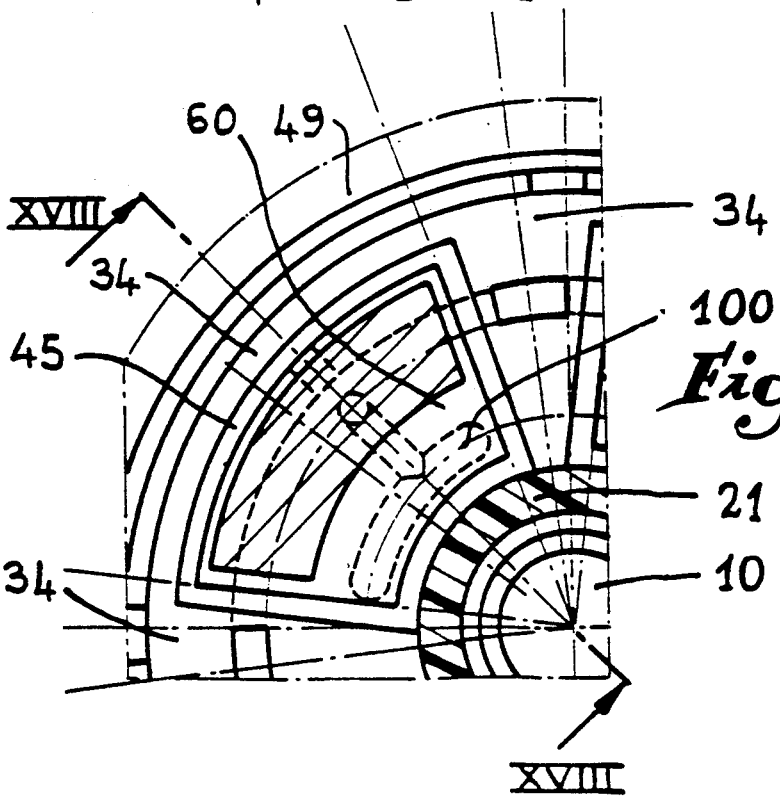
FIG. 20 is a section view along line XX—XX of FIG. 18 showing the groove 100 incorporated in the side of sector 60, on the driven gear 10. The plane of section of FIG. 18 has been shown at XVIII—XVIII.
Figure 19:
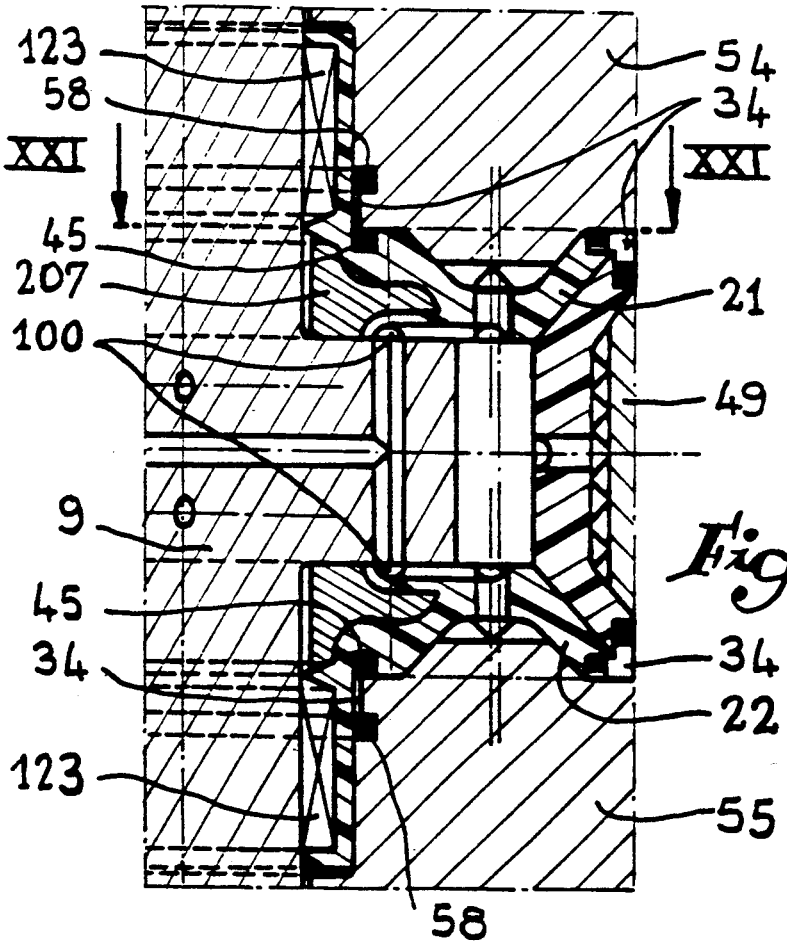
FIG. 19 is a partial section view along line XIX—XIX of FIG. 21 illustrating the new relative arrangement of the seals 58 and 45 on the side of driving gear 9.
Figure 21:
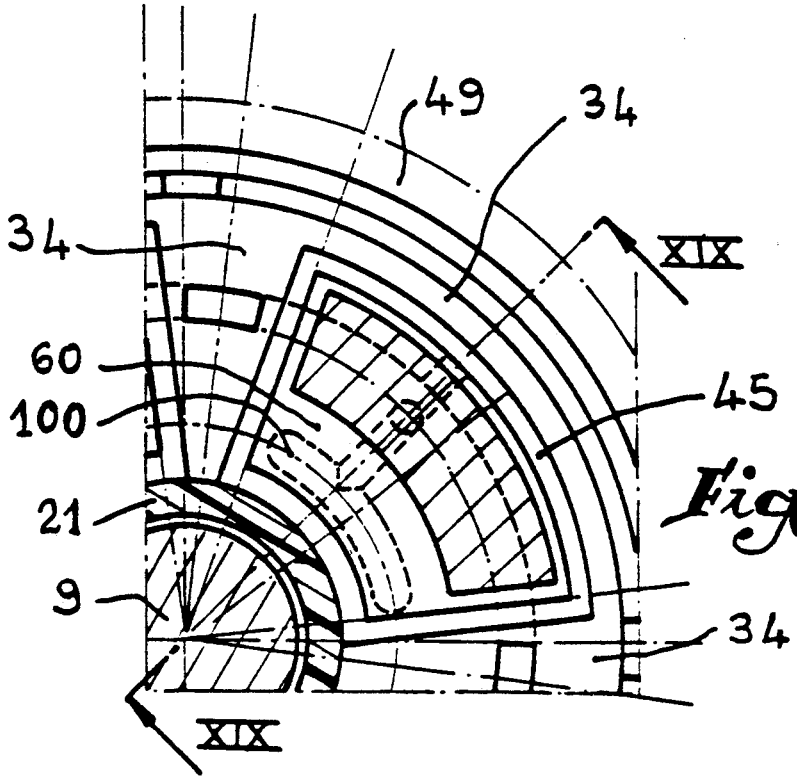
FIG. 21 is a section view along line XXI—XXI of FIG. 19 showing the groove 100 incorporated in the sector 60, on the driving gear 9 side. The plane of section XIX—XIX of FIG. 19 is shown in this figure.

Similarly, the connecting conduit 23 may take the form referenced 214 on the large cubic capacity generator-receivers, in order to promote the creation of the fluid bearings (FIG. 17).

The action of the pressure in zone 34 at the level of grooves 100 has led to placing a metal insert, i.e., collector 207, in side plates 21, 22. In order to reduce the action of this pressure in zone 34 between the seals 58 and 45 (and 45', 45''), a novel arrangement of this zone consists in disposing seal 58 above seal 45 (FIG. 18), housing it in a groove in covers 54 and 55. Sector 60 then embraces grooves 100 which are subjected to the same compensation pressure as sector 60 (either HP, or LP). The collector 207 may then be reduced in diameter and grooves 100 possibly again provided in the plastic part. This arrangement requires the use of a tie 221 on the driven gear side, said tie and the bearing 123 on the driving gear side then being inserted in the plastic of side plates 21, 22. This plastic insertion makes it possible to render the bearing-flange assembly monobloc, to angularly disconnect tie 221 and bearing 123 from collector 207 and to overcome the misalignment of the bores of the bearings. These arrangements are illustrated in FIGS. 18, 19, 20 and 21.

For high torques at low speed of rotation, requiring large cubic cylinders, the latter may be obtained by providing a more or less large number of planet gears (driven gears). This arrangement makes it possible to obtain smaller dimensions and to be able to play on these dimensions either by producing material of large diameter and short length, or the reverse. This construction is facilitated by playing on the number of teeth Z of the driving gear and the number of teeth z of the driven planet gears.

| Possible constructions: n planet gears | | |
|---|---|---|
| n = 1 Planet gear | Z = z | for 2 N = 4 on driving gear. |
| n = 2 Planet gears | Z = z | for 2 N = R on driving gear. |
| n = 3 Planet gears | Z = 1.5 | z for 2 N = 6 on driving gear. |
| n = 4 Planet gears | Z = 2 | z for 2 N = 8 on driving gear. |

n = n Planet gears $Z \geqq \frac{nz}{2}$ for 2 N = 2n on driving gear.

It should be noted:

- that the number of sectors on the driven gear is always equal to four, two opposite HP sectors and two opposite LP sectors.
- that the sectors on driving gear are, whatever their number, either HP or LP, but not at intermediate pressure.
- that, when n is odd, the driving gear cannot have balancing conduits, the opposite sectors being respectively HP and LP, which does not disturb the general balancing, the latter being effected via the hydrostatic compensation sectors on the side plates.
- that the cubic capacity per revolution is equal to the cubic capacity per revolution of the driving gear multiplied by the number of planet gears n, viz.:
  - cubic capacity per revolution $C = KM^2ZH \times n \times C$ with KM = height of tooth, M apparent diametral pitch, H width of toothing, n number of planet gears.
- that, if n is even, the opposite planet gears may be short-circuited by a hydraulic valve making it possible to have n/2 possible cubic capacities.

Figure 22:
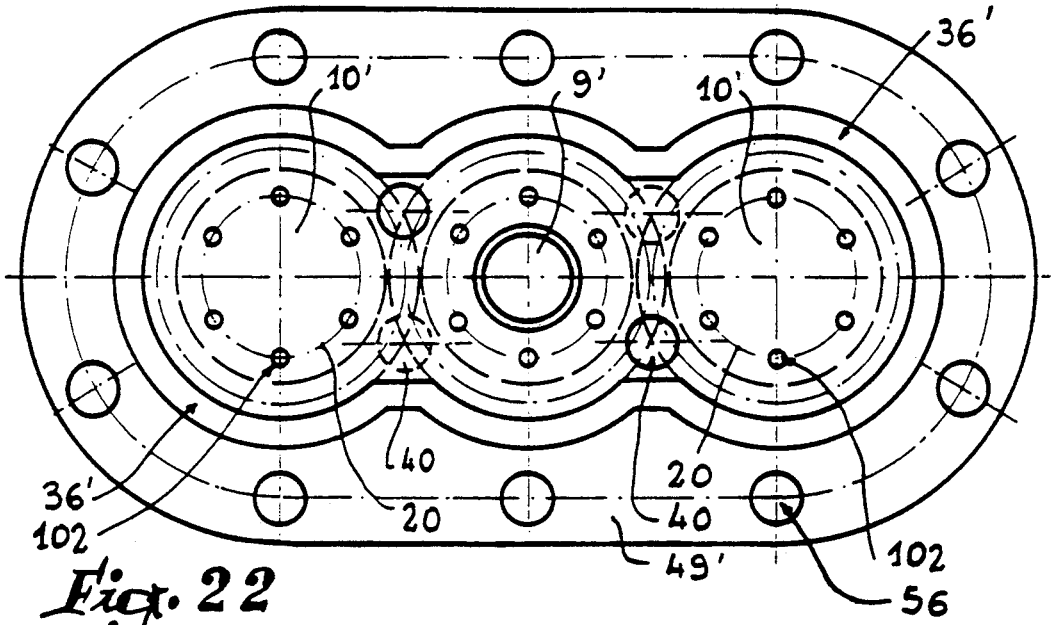
FIGS. 22 and 23 show a generator-receiver according to the invention comprising two and three planet gears and illustrated with the cover and flange removed.
Figure 23:
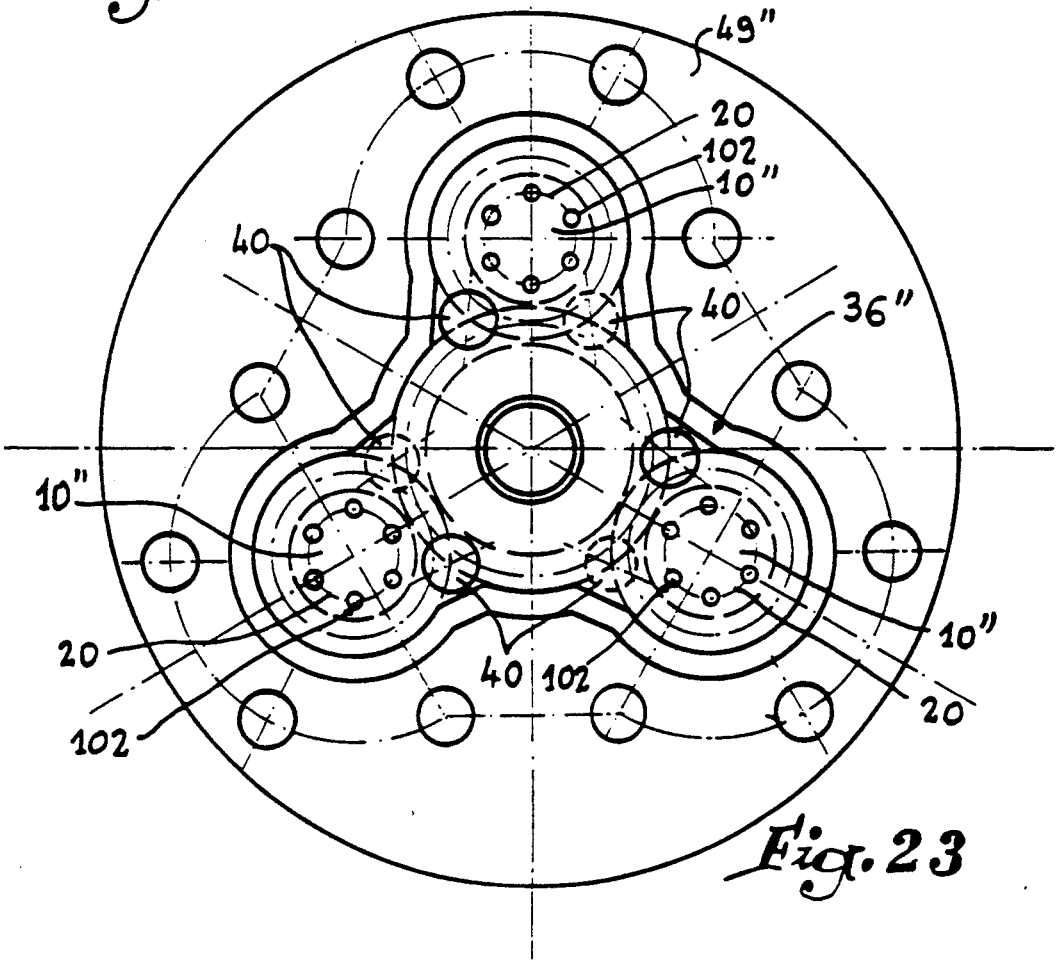

FIGS. 22 and 23 illustrate these arrangements. FIG. 22 shows a generator-receiver, with cover and side plate removed, constructed with two planet gears. The driven gears are referenced 10'. The driving gear 9' comprises the same number of teeth (Z) as that (z) of the driven gears. The assembly swivels in the envelope 36' housed in body 49'. HP-LP orifices 40 are either HP or LP on the same side (solid lines at the same pressure, either HP or LP; broken lines at the same pressure, either LP or HP). Balancing is effected in the same manner as in the preceding constructions; the driving gear may be balanced by the rotor conduits since the opposite sectors are at the same pressure potential.

FIG. 23 shows a generator-receiver, with cover and flange removed, comprising three planet gears of which the driven gears are referenced 10'' and the driving gear 9''. The driving gear 9'' is provided with a number of teeth Z 1.5 times greater than that (z) of the driven gears 10''.

The assembly swivels in an envelope 36'' housed in the body 49''. HP-LP orifices 40 are either HP or LP, on the same side. Balancing is effected in the same manner as in the preceding constructions. However, the driving gear cannot be balanced by the rotor conduits since the opposite sectors are not at the same pressure potential. Balancing of the driving gear is effected via the hydrostatic compensation sectors provided on the side plates.

What is claimed is:

1. A reversible generator-receiver comprising an assembly comprising (a) a plurality of free-floating helical gear means (9, 10) including a driving gear and at least one driven gear interengaging at a mesh point, said gear means having teeth defining spaces between said teeth and two sides, one of said gears (9) having a shaft cooperating with bearings (123);

(b) a flexible envelope (36) having an inner face surrounding said gear means (9, 10) and having conduits (43) therein;

(c) a plurality of side plates (21, 22) made of plastic material and bearing against sides of said gear means (9, 10) and in abutment against said envelope (36) by a contact surface at a 45° angle, and provided with seals (58);

(d) a rigid body (49) and covers (54, 55) having bores and enclosing (a), (b) and (c);

(e) hydraulic sectors (38) for pressurizing a periphery of said flexible envelope (36) so as to force said flexible envelope against crests of said teeth so as to render said spaces fluid-tight;

(f) opposed hydrostatic compensation sectors (60) for applying equilibrated pressure to said side plates (21, 22) so as to obtain fluid-tightness on both sides of said gear means (9, 10);

(g) a hydraulic winding comprising a plurality of rotor conduits in said free-floating gear means (9, 10) and a plurality of stator conduits (23) in said side plates, successive commutations between said plurality of rotor conduits and said stator conduits being provided by ends of said conduits passing one in front of the other along a circle of commutation (20) and simultaneously on said tooth spaces at the level of a rolling pitch circle for another end of said stator conduits to provide permanent connection between said opposed tooth spaces except in zones wherein hydraulic bearings are created, each zone of said hydraulic bearings which is opposite said mesh point being accompanied by (i) a break in the connection between tooth spaces at a given point and a point opposite said given point, and (ii) conservation of pressure by supplying said hydraulic bearing which are created with high pressure via a conduit member from a zone (34) of permanent total pressure;

(h) said rotor conduits into said gears (9, 10) being constituted by groups of first conduits (102) diametrically opposed around said circle of commutation (20) and parallel to an axis of said gear means, and connecting said diametrically opposed conduits (102) at $\pi$;

(i) said rotor conduits supplying said stator conduits in said plates (21, 11) and said casing (36) through cavities (100) on said circle of commutation (20) and second conduits (23);

(j) priority valve means (116) being provided for selectively pressurizing and depressurizing said zone (34) of permanent total pressure;

(k) said side plates (21, 22) being molded on an insert comprising two circular parts joined by a bi-concave joint and having an inner face and an outer face, said outer face being flush with the inner face of each said side plate;

(l) said outer face of said insert comprising grooves (210) into each of which the plastic material constituting said side plates (21, 22) penetrates to form a bead in which each said cavity (100) is formed.

2. Reversible generator-receiver according to claim 1, wherein said covers (54, 55) and said body (49) have respectively projections (201, 201', 201'') and bosses (203, 203') having lateral inclined faces, and said side plates and envelope have corresponding recesses having lateral inclined faces made correspondingly, said lateral faces of projections and bosses cooperating with a difference of the order of 5° with the lateral faces of corresponding recesses to allow assembly by force of said side plates and said envelope at the level of said contact surface.

3. Reversible generator-receiver according to claim 1, wherein said inner face of said envelope (36) has grooves (212) which are connected to and eccentric with respect to said conduits (43).

4. Reversible generator-receiver according to claim 1, wherein each said side plate (21, 22) houses a tie (221) on a side of said driven gear and said bearing (123) while said seal (58) is housed in a groove of the bore of the corresponding said cover (54, 55).

* * * * *